United States Patent [19]

Morelli et al.

[11] Patent Number: 4,694,568

[45] Date of Patent: Sep. 22, 1987

[54] METHOD OF MANUFACTURING CHIP RESISTORS WITH EDGE AROUND TERMINATIONS

[75] Inventors: Amedeo J. Morelli, Randolph, N.J.; Francis L. Gaylord, Painted Post, N.Y.

[73] Assignee: North American Philips Corporation, New York, N.Y.

[21] Appl. No.: 337,644

[22] Filed: Jan. 7, 1982

[51] Int. Cl.[4] ..... H01C 17/06

[52] U.S. Cl. ..... 29/620; 29/413

[58] Field of Search ..... 29/610, 620, 413; 219/121 EB, 121 EH, 121 EK, 121 EJ, 121 LG, 121 LH, 121 LJ; 338/195, 203, 308, 320

[56] References Cited

U.S. PATENT DOCUMENTS

| | | | |
|---|---|---|---|
| 3,112,850 | 12/1963 | Garibotti | 219/121 EK |
| 3,519,504 | 7/1970 | Cuomo | 29/578 |
| 4,159,461 | 6/1979 | Kost et al. | 29/620 |

OTHER PUBLICATIONS

Electronics, Aug. 16, 1979, pp. 72–73.

*Primary Examiner*—Percy W. Echols
*Attorney, Agent, or Firm*—Norman N. Spain

[57] ABSTRACT

The rate of production of chip resistors is greatly increased by forming rows of chip resistors on a substrate, laser trimming the rows of resistors while still on the substrate, breaking up the substrate into separate rows of chip resistors, applying edge-around terminations to each of the separated rows of the chip resistors and separating the chip resistors from each other.

14 Claims, 1 Drawing Figure

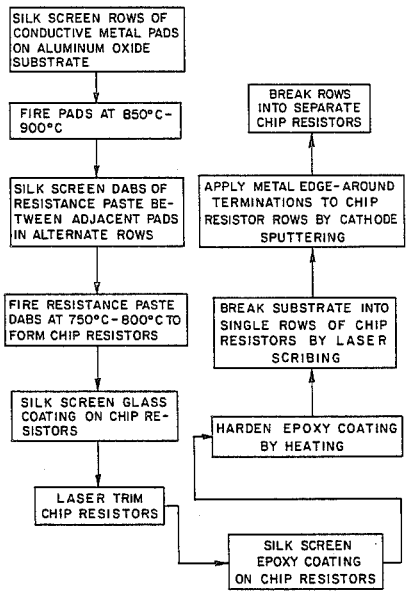

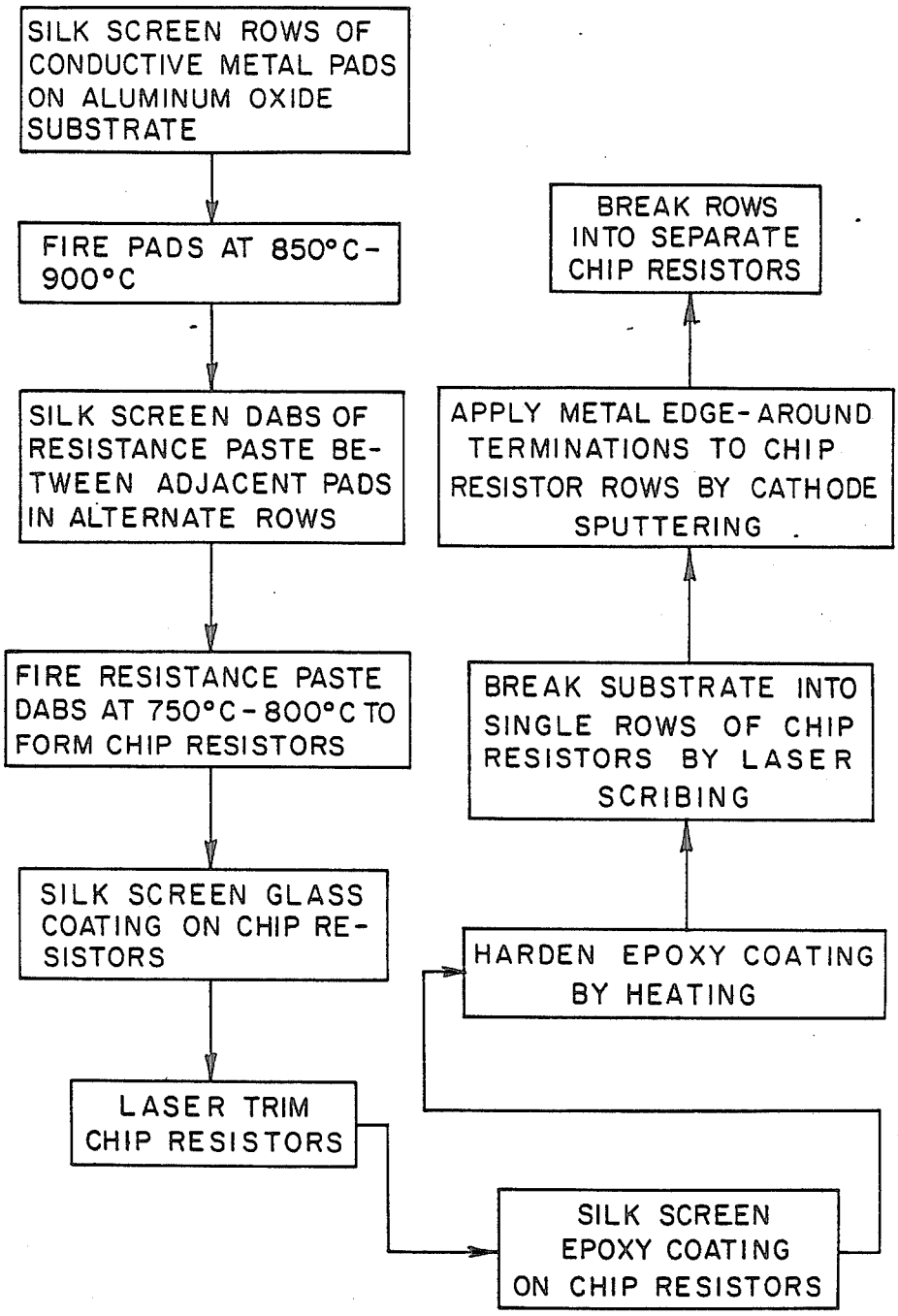
SILK SCREEN ROWS OF CONDUCTIVE METAL PADS ON ALUMINUM OXIDE SUBSTRATE
FIRE PADS AT 850°C-900°C
SILK SCREEN DABS OF RESISTANCE PASTE BETWEEN ADJACENT PADS IN ALTERNATE ROWS
FIRE RESISTANCE PASTE DABS AT 750°C-800°C TO FORM CHIP RESISTORS
SILK SCREEN GLASS COATING ON CHIP RESISTORS
LASER TRIM CHIP RESISTORS
SILK SCREEN EPOXY COATING ON CHIP RESISTORS
HARDEN EPOXY COATING BY HEATING
BREAK SUBSTRATE INTO SINGLE ROWS OF CHIP RESISTORS BY LASER SCRIBING
APPLY METAL EDGE-AROUND TERMINATIONS TO CHIP RESISTOR ROWS BY CATHODE SPUTTERING
BREAK ROWS INTO SEPARATE CHIP RESISTORS

METHOD OF MANUFACTURING CHIP RESISTORS WITH EDGE AROUND TERMINATIONS

BACKGROUND OF THE INVENTION

This invention relates to a new and novel method for the production of chip resistors.

Chip resistors are small film resistors formed of thick dabs of resistive material in contact with conductive metal pads all deposited on a surface of a small piece or chip of an insulating ceramic substrate such as aluminum oxide substrate.

These chip resistors may be employed as resistors in printed circuit boards.

In order to provide a leadless electrical contact with other components with these printed circuit boards the chip resistors are provided with thin conductive metal bands or edge-around terminations each of which is in contact with one of the metal pads and extends over an edge, and sometimes to the rear surface of the chip. Through these edge-around terminations the chip resistors are electrically connected and secured in the printed circuit board by such techniques such as wave soldering, the use of clamps or, in some cases a combination of both.

Such chip resistors are well known in the art and are described for example in Electronics, Aug. 16, 1979, pp. 72–73.

In the method usually employed in producing the chip resistors, series of rows of conductive metal pads and the connecting dabs of resistance material are deposited on a surface of a large sheet of an alumina substrate, generally by using a screening and firing technique. A protective glass coat is then applied and the thin substrate is then separated into large rows of chips.

The rows of chips are then stacked and the edge around terminators are then applied by a screening or dipping technique followed by firing at a high-temperature, frequently at 815° C.–900° C., to fire the edge around terminators.

Because of the high temperature employed in forming the edge-around terminations by this means laser-trimming cannot be carried out until each chip resistor is separated. Because the laser trimming must be then carried out on each chip separately the production rate is low and in some cases so low as to be economically unsatisfactory.

However, while laser trimming of a number of resistors in a resistor network prior to application of mechanically connected terminals is known in the art, as shown by Kost et al U.S. Pat. No. 4,159,461, there is no teaching in the art of a method for the production of chip resistors furnished with permanently attached edge-around terminations formed by a deposition process in which laser trimming is carried out while all the resistors are still present on the substrate.

BRIEF SUMMARY OF THE INVENTION

It is an object of this invention to provide a new and novel method of producing chip resistors in which a significantly higher rate of produciton is achieved. This and other objects of the invention will be apparent from the description that follows.

According to the invention it has been found that a significant increase in the production rate for the manufacture of chip resistors is achieved by a novel combination of steps in which first an even series of rows of electrically conductive metal pads are deposited on a surface of a thin electrically insulating ceramic substrate. The rows of the metal pads are deposited in such a manner that one row of the conductive metal pads is adjacent to a first edge of the substrate and a second row of the metal pads is adjacent to a second edge of the substrate essentially parallel to said first edge. The metal pads are then fixed by firing and dabs of resistive material are then deposited between adjacent pairs of the metal tabs to form thereby rows of chip resistors. The dabs of resistive material are then fixed by firing.

After this firing step the chip resistors are laser trimmed to desired values while still present on the substrate.

Subsequent to trimming, the substrate is broken up into separate rows or strips of chip resistors.

By a vapor deposition technique conductive metal bands or edge-around terminations are deposited along each longitudinal edge of the strip so as to extend over the longitudinal edge and the metal pads adjacent to the edge.

After deposition of the edge-around terminations the rows of chip resistors are broken up into individual chip resistors.

Preferably, in order to protect the chip resistors during the trimming operation, a protective glass coat is deposited over each dab of resistive material prior to the trimming operation.

While there are various methods available for depositing the conductive metal pads and dabs of resistive material on the substrate, deposition by screening has been found to be the most useful and is preferred.

The trimming operation may be carried out by various known techniques such as sand blasting (such as is referred to in the aforementioned Electronics article, or Neese, U.S. Pat. No. 4,163,315 for example), by use of an electron beam or by use of a laser beam.

Of these methods, laser trimming is preferred as by this means accurate trimming of the resistors may be accomplished at the least cost.

Laser trimming of film resistors is a technique that is well known and well documented in the art. See for example McWilliams, U.S. Pat. No. 3,699,649, Bube, U.S. Pat. No. 3,947,801, and Optical Engineering, May–June 1978, Vol. 17, No. 3, pp. 217–224, the contents of all of said references being hereby incorporated by reference.

Following the laser trimming step a plastic protective coating such as an epoxy coating may be applied by screening over the resistor chip. At this stage it is advantageous to scribe fragmentation lines in the substrate to permit of easy separation first into rows of the chip resistors and subsequently into individual resistors.

While all vapor vacuum techniques may be used, preferably the edge-around terminations are deposited in the rows of the chip resistors by cathode sputtering. Deposition of metallic layers by cathode sputtering is also a technique that is well known in the art as is shown by Cuomo U.S. Pat. No. 3,519,504 the contents of columns 6 and 7 and FIG. 3, the contents of which are hereby incorporated by reference.

More particularly the method of the invention is carried out as follows:

A series of regularly spaced conductive metal pads for example of a palladium silver composition are applied by a screening technique to a major surface of a large thin aluminum oxide substrate. The substrate is then fired to about 850°-900° C. for about 10 to 15 minutes to fix the conductor pads to the substrate.

Dabs of a resistor paste for example a mixture of a glass frit and a metal resinate and/or a ruthenium oxide are then applied by a screening technique to the substrate between alternate adjacent conductive metal pads so as to electrically join these resistor pads and form a series of rows of resistors on the substrate. The substrate is then fired at a temperature of 750°-800° C. to fix the resistor paste dabs.

A low temperature melting glass coating is then applied to the surface of the substrate bearing the resistors by screening glass paste to said surface and heating to about 625° C.

Laser trimming of the resistor is then carried out while all the resistors are still present on the substrate by use of one of the aforementioned techniques or by other well known techniques.

Fragmentation lines are then scribed into the substrate by laser or mechanical techniques to provide a means for easily breaking the substrate into strips of single rows of resistors and then each strip into individual chip resistors. At this stage optionally a protective plastic coating such as an epoxy or a silicon coating is applied to the substrate surfaces.

The substrate is now split into strips of single rows of chip resistors along the fragmentation lines and the strips are then placed in a cathode sputtering chamber and positioned in such a manner that the longitudinal edges and those portions of the major surfaces upon which the edge-around terminations are to be formed are exposed to the metal targets. Preferably a combination of three metals is employed, a thin first layer of chrome, nichrome, or titanium, a somewhat thicker layer of nickel and then a layer of solder, for example a tin-lead solder layer all applied by use of appropriate targets for use in a cathode sputtering technique. During the sputtering operation the heat generated is kept at a minimum and preferably not in excess of 150° C.

After the sputtering operation is finished, the strips are then broken along the remaining fragmentation lines into the individual chip resistors.

By the use of the method of the invention the rate of production of the resistor chips is greatly increased by as much as four times in many cases.

Resistor chips of values from 10 ohms-2 megohms with tolerances of ±0.5% may be readily produced.

BRIEF DESCRIPTION OF THE DRAWING

The sole FIGURE in the drawing is a flow chart showing in sequential form the steps employed in carrying out a preferred embodiment of the method of the invention.

DESCRIPTION OF THE PREFERRED EMBODIMENT

By use of a silk screen printing technique a series of parallel rows of conductive pads of silver palladium were formed on a major surface of a $2\times2\frac{1}{2}\times0.025$ inch substrate of an approximately 96% pure aluminum oxide. Each silver palladium pad had a dimension of approximately $0.025\times0.040$ inch and a thickness of about 12 microns. The substrate was then fired at about 850°-900° C: for about 15 to 30 minutes to fire the pads to cause them to adhere firmly to the substrate.

The substrate was then subjected to an additional screen printing technique whereby dabs of resistant paste were deposited between the pads in alternate adjacent rows of the pads. These dabs of resistant paste were comprised of a composition containing lead borosilicate and ruthenium dioxide and were applied in a manner so as to electrically connect pads in alternate adjacent rows, each dab having a thickness of aproximately 9 microns, a length of approximately 0.070 inch and a width of aproximately 00.040 inch.

These resistant paste dabs were then fixed and caused to adhere firmly to the substrate by being fired at about 750° C.-800° C. for about 15 to 30 minutes.

A protective glass coating formed of a glass softening at about 625° C. was then applied by silk screening on the surface of the substrate bearing the chip resistors in a manner so as to cover all the resistant paste dabs but to leave exposed at least a portion of each of the pads. The chip resistors were then laser trimmed by use of a laser trimming technique such as disclosed in the E.I. du Pont deNeumors & Co. Publication No. E-10690-1 (1976) "Laser Trimming Techniques for Thick Film Resistors", a YAG laser with a Q value of 427 and a power of approximately 1 to 3 Watts being employed. By this means the resistor chips were trimmed to a resistance of about 1,000 ohms with tolerances of ±0.5%.

By a still further silk screening step a thin protective epoxy layer of a thickness of approximately 9 microns was applied to all areas of the substrate bearing the chip resistors except the exposed areas of the pads. The resultant epoxy layer was then hardened by heating at a temperature of 200° C.

By the use of a laser scribing technique employing a $CO_2$ laser fragmentation lines were scribed in the surface of the substrate between each chip resistor. The substrate was then broken into strips of single rows of chip resistors along fragmentation lines separating the rows of chip resistors.

A number of the strips of the chip resistor were then arranged in a jig in a cathode sputtering chamber so as to leave exposed a longitudinal edge of each strip and a portion at least of each metal pad adjacent to said edge but masking the resistant paste dabs.

The strips were then successively exposed to sputtering from nichrome target, a nickel target and a lead-tin target employing a method similar to that described in the aforementioned Cuomo U.S. Pat. No. 3,519,504. The sputtering operation was carried out for about 1 hour and the temperature was maintained at a temperature of about 150° C. By this means there was formed edge-around termination overlapping one longitudinal edge of each strip and being formed of a first nichrome layer of about 1200 Angstroms thick, an intermediate nickel layer of about 10,000 Angstroms thick and an outer layer of a lead-tin solder of about 30,000 Angstroms thick.

The operation was then repeated on the opposing longitudinal edge of the strips.

The strips were then broken up into individual chip resistors along the remaining fragmentation lines.

By this means approximately 500 1000 ohm chip resistors each with tolerances of ±0.5% and with dimensions of about $0.062\times0.125\times0.025$ mm were produced. These chip resistors were readily solderable to other components in a printed circuit board by way of wave soldering.

It will be apparent that various modifications may be made to the method of the present invention without departing from the scope of the invention as defined by the following claims.

What is claimed is:

1. A method of manufacturing chip resistors comprising:

(a) depositing an even series of electrically separated, essentially parallel rows of electrically conductive metal pads on a major surface of a thin electrically insulating ceramic substrate, each of said metal pads facing an opposing pad in an opposing row of other said pads, one row of said metal pads being adjacent to a first edge of said substrate and a second row of said metal pads being adjacent to a second edge of said substrate essentially parallel to said first edge, (b) firing said metal pads at a temperature sufficient to fix said metal pads to said substrate, (c) depositing resistor paste dabs extending between, and in electrical contact with, opposing metal pads in opposing rows of said metal pads, and in a manner such that each of said metal pads is electrically connected with only one other of said metal pads thereby forming at least one row of at least two electrically separated resistors on said surface of said substrate, (d) firing said resistor paste dabs at a temperature sufficient to fix said resistor paste dabs to said substrate, (e) trimming each of said resultant resistors to a desired value, (f) scribing fragmentation lines in said surface of said substrate between each of said resistors, (g) breaking said substrate along fragmentation lines separating the rows of resistors into strips each strip containing a single row of resistors, (h) depositing by vapor deposition, narrow electrically conductive metal bands over each of said rows of metal pads adjacent to an edge of said substrate, and extending over said adjacent edge thereby forming edge-around terminations on said resistors and (i) separating said resistors, one from another, along said fragmentation lines.

2. The method of claim 1 wherein said trimming is done by laser means.

3. The method of claim 1 wherein at least two rows of resistors are formed and each row is separated along fragmentation lines prior to vapor depositing of said narrow bands of conductive material.

4. The method of claim 2 wherein prior to laser trimming a glass coating is applied to said resistor paste dabs.

5. The method of claim 4 wherein subsequent to laser trimming a synthetic resin coating is applied to the surface of said substrate bearing said resistors in a manner such that each of said resistive paste dabs is covered by said synthetic resin coating but at least a portion of each of said metal pads is left exposed.

6. The method of claim 5 wherein the substrate is an aluminum oxide substrate.

7. The method of claim 6 wherein the conductive metal pads are thin silver palladium pads.

8. The method of claim 6 wherein the narrow conductive metal bands are deposited by cathode sputtering.

9. The method of claim 8 wherein the conductive metal bands are formed of three metal layers, the first metal layer, in contact with said substrate, being nichrome, the second, intermediate layer, being nickel and the third and top layer, being a tin lead solder.

10. The method of claim 9 wherein the conductive pads are deposited by screen printing.

11. In the method of claim 10 wherein the resistor paste dabs are deposited by screen printing.

12. The method of claim 5 wherein the synthetic resin coating is an epoxy resin coating.

13. A method of manufacturing chip resistors with edge-around terminations comprising, (a) depositing, by screen printing, an even number of essentially parallel rows of conductive pads of silver palladium on a surface of a thin, essentially rectangular, aluminum oxide substrate, one row of said conductive pads being adjacent to an edge of said surface and a second row of said conductive pads being adjacent to an opposite edge of said surface, (b) firing said conductive pads to about 900°–950° C. to fix said conductive pads to said substrate, (c) depositing, by screen printing, resistor paste dabs of a mixture of a lead borosilicate glass and ruthenium dioxide extending between, and in contact with, opposing pairs of conductive pads in alternative adjacent rows of said conductive pads thereby forming rows of resistors on said substrate, (d) firing said resistor paste dabs at about 800°–850° C. to fix said resistor paste dabs to said substrate, (e) depositing by screen printing a thin glass layer on all of the resultant resistors while leaving exposed a portion at least of each of said conductive pads, (f) laser trimming said resistors to desired values, (g) applying by screen printing, a thin epoxy resin coating composition on all of said resistors while leaving exposed a portion at least of each of said conductive pads, (h) heating said substrate to about 180°–220° C. to harden said epoxy resin coating, (i) scribing fragmentation lines in said substrate between each row of resistors and between each of said resistors, (j) breaking said substrate along those fragmentation lines separating the rows of resistors thereby breaking said substrate into individual strips of single rows of resistors, (k) applying, by cathode sputtering, a narrow conductive metal band on each longitudinal edge of each of said strips and extending over the exposed surfaces of said pads, each of said metal bands being electrically separate from the other and being formed of a first thin layer of nichrome, an intermediate layer of nickel and an outermost layer of a lead tin solder thereby forming edge-around terminations on all of said resistors and (l) breaking said strips along remaining fragmentation lines into individual chip resistors, each chip resistor bearing edge-around terminations.

14. A method of manufacturing chip resistors comprising:

(a) forming a series of rows of film resistors on a major surface of a thin electrically insulating ceramic substrate, each resistor comprising a pair of electrically conductive metal pads joined by a film of resistor material, (b) trimming each of said resistors to a desired value, (c) separating said substrate into strips of single rows of said resistors, (d) depositing by vapor deposition narrow conductive metal bands extending over each longitudinal edge of each of said strips and over the metal pads adjacent to said edge, (e) and separating each of said strips into individual chip resistors, each chip resistor having edge-around terminations.

* * * * *